US008210406B2

(12) United States Patent
Moreau et al.

(10) Patent No.: US 8,210,406 B2
(45) Date of Patent: Jul. 3, 2012

(54) TOOL LANYARD WRIST CUFF

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 245 days.

(21) Appl. No.: 12/473,525

(22) Filed: May 28, 2009

(65) Prior Publication Data

US 2009/0294495 A1 Dec. 3, 2009

Related U.S. Application Data

(60) Provisional application No. 61/056,605, filed on May 28, 2008.

(51) Int. Cl.
*A45F 3/14* (2006.01)
*A45F 5/00* (2006.01)
*A44C 5/00* (2006.01)

(52) U.S. Cl. ..... 224/221; 224/222; 224/219; 224/267

(58) Field of Classification Search ..... 224/221, 224/222, 219, 267, 269, 901, 904
See application file for complete search history.

(56) References Cited

U.S. PATENT DOCUMENTS

| | | | | |
|---|---|---|---|---|
| 272,067 | A * | 2/1883 | Lindsay | 224/220 |
| 4,315,641 | A | 2/1982 | Larsen | |
| 4,728,123 | A | 3/1988 | Kassal et al. | |
| 5,082,156 | A | 1/1992 | Braun | |
| 5,130,899 | A | 7/1992 | Larkin et al. | |
| 5,154,506 | A * | 10/1992 | Leard | 362/103 |
| 5,257,729 | A * | 11/1993 | Silvernail | 224/219 |
| 5,374,919 | A * | 12/1994 | Zelka et al. | 340/574 |
| 5,915,336 | A * | 6/1999 | Watson | 119/797 |
| 6,095,093 | A * | 8/2000 | Kisko et al. | 119/770 |
| 2004/0084489 | A1 * | 5/2004 | Murphey et al. | 224/221 |
| 2006/0124675 | A1 * | 6/2006 | Calicott | 224/222 |

FOREIGN PATENT DOCUMENTS

GB 2353752 A 3/2001

* cited by examiner

*Primary Examiner* — Nathan J Newhouse
*Assistant Examiner* — Lester L Vanterpool
(74) *Attorney, Agent, or Firm* — Robert R. Deleault, Esq; Mesmer & Deleault, PLLC

(57) ABSTRACT

A tool lanyard wrist cuff includes a fixed, closed loop band having a first mating portion of a fastening mechanism fixedly attached to an outside surface of the closed loop band, an adjustment tab extending from the fixed, closed loop band where the adjustment tab has a second mating portion of the fastening mechanism configured for releasable engagement with the first mating portion when the fixed closed loop band is folded onto itself positioning the adjustment tab over and onto the outside surface of the closed loop band, and a lanyard retaining component integrally formed on the outside surface of the closed loop band.

10 Claims, 2 Drawing Sheets

TOOL LANYARD WRIST CUFF

This application claims the benefit of U.S. Provisional Patent Application No. 61/056,605, filed May 28, 2008.

BACKGROUND OF THE INVENTION

1. Field of the Invention

The present invention relates generally to tool lanyards. Particularly, the present invention relates to tool lanyards attached to a user's wrist.

2. Description of the Prior Art

Persons engaged in repair and construction type work ordinarily have to use a variety of hand tools to perform tasks. The work commonly takes place over machinery and/or on platforms at various heights above the ground.

There are many reasons that persons engaged in such work avoid dropping tools. For instance, a dropped tool must be picked up before a person can continue using it to complete a particular task. This entails wasted time and energy in climbing down from a considerable height just to pick up the tool. Oftentimes, the dropped tool will land in a place out of the user's sight. In those circumstances, a search must be undertaken to locate the tool. This further increases the amount of wasted time in retrieving a dropped tool.

Another, more serious concern with the use of hand tools (i.e. hammers, screw drivers, pliers, ratchets, levels, flashlights, tape measures, etc.) occurs when working in overhead situations. If dropped, the hand tool could cause a hazard to personnel and/or equipment located beneath where the work is being performed. A dropped tool exposes persons located below to potential injury or even death if struck by the falling tool. A dropped tool also has the potential to cause damage to machinery located below. The damage can result in many ways. For instance, the damage can be due to the impact of the falling tool on the machinery or parts. Where machinery is operating at the time, the falling tool may come to rest in the path of moving components causing damage to the components and/or necessitate shutting down the machinery.

While without doubt, persons using hand tools try to maintain sufficient grip on the tool, conditions are practically certain to arise in which tools will be dropped. Moisture from sweating frequently makes it difficult to maintain the necessary grip on the tool handle. Muscular fatigue can cause a person's grip to loosen without consciously realizing it. In reaction to an unexpected slip, the person may unconsciously drop the tool in grabbing for some support structure to prevent or cushion the fall.

There have been many attempts to overcome these hazards with dropped tools. Makeshift lanyards using rope and/or string with duct tape as a fastening means has infamously been used to create wrist lanyards and tethers to keep a specific tool contained to the user's arm or wrist.

The more conventional type tool lanyards that are used to tether hand tools are of the one size fits all styles and are typically made of a rope or string, and can be adjusted to the user's wrist with the use of a cord lock that slides along the rope. This style lanyard can be uncomfortable to the user and will have to be replaced often due to lack of wear protection inherent with rope.

Another style of one size fits all lanyards are the types manufactured with webbing sewn to hook and loop fasteners with a hardware loop (or equivalent) that can be used as a cinching point to tighten the lanyard around the user's wrist. The problem with these types are that, if not used properly, it will require the use of two hands to fasten it to the user's wrist or the use of one hand to wedge it against the user's body while using the other hand to cinch it around the user's wrist, thus, making it very cumbersome to install on the user's wrist.

Other styles of wrist cuff tool lanyards are manufactured of a stretch nylon fabric or equivalent that will slightly expand to allow the wrist cuff to expand and slide over the user's wrist. The expansion ratio of the stretch nylon cannot be too excessive otherwise if any weight is applied while the lanyard is in use, the tendency will be that the wrist cuff will slide over the users wrist and fall off. With this style there has to be multiple sizes to fit a range of wrist sizes.

Examples of such devices are disclosed. U.S. Pat. No. 4,728,123 (1988, Kassal et al.) discloses a releasable strap system. The releasable strap system includes the combination of a hand strap and a device strap. The hand strap is removably connectable around the wrist of a hand and between two of the five fingers of the hand leaving the hand free for normal use. The hand strap includes two portions, a straight wrist portion and a curved looped portion. The loop portion has two ends connected to the straight wrist portion at separated intervals. The straight wrist portion is wrapped around the wrist of the user and threaded through a ring and tightened and folded back and locked in position. The device strap is removably connected to the hand strap for supporting an item not held in the hand of the user and for quick release from the hand strap.

U.S. Pat. No. 5,130,899 (1992, Larkin et al.) discloses a tool restraint apparatus. The tool restraint includes an elongate elastomeric tether line with a respective first and second flexible strap mounted to each end. The first web strap is arranged for selective securement about a user's wrist and includes a first and second end that includes first and second hook and loop fastener patches to permit securement of the first and second hook and loop fastener patches together. The second web strap is similarly constructed like the first web strap.

U.S. Pat. No. 5,082,156 (1992, Braun) discloses a tool wrist strap that has a band, a looped cord and a clench bead on the cord. The band is made of a flexible elastic fabric material and formed by an elongate strip having opposite ends attached together. The band is adapted to fit loosely about a person's wrist. The looped cord is composed of flexible inelastic material and has a looped end portion and a pair of opposite ends attached to the band adjacent to one another. The clench bead is slidable on the looped cord and produces sufficient friction to hold the bead in any given position along the cord.

Therefore, what is needed is an ergonomically designed wrist lanyard that fits a range of wrist sizes.

SUMMARY OF THE INVENTION

It is an object of the present invention to provide a wrist lanyard that fits a range of wrist sizes. It is another object of the present invention to provide a wrist cuff for use with tool lanyards.

The present invention achieves these and other objectives by providing a one-size-fits-all wrist cuff tool lanyard. In one embodiment of the present invention, there is a tool lanyard wrist cuff that includes a fixed, closed loop band having a first mating portion of a fastening mechanism fixedly attached to an outside surface of the closed loop band, an adjustment tab extending from the fixed, closed loop band where the adjustment tab has a second mating portion of the fastening mechanism configured for releasable engagement with the first mating portion when the fixed closed loop band is folded onto itself positioning the adjustment tab over the outside surface of the closed loop band, and a lanyard retaining component integrally formed on the outside surface of the closed loop band. The fixed closed loop band and the adjustment tab may be the same material or different materials. The adjustment tab may be a separate piece fixedly attached to the fixed closed loop band or it may also be an extension of the same strip material that is used to make the fixed closed loop band.

The fastening mechanism may be one of many different devices including a strap and buckle, a snap button, a button and strap with button holes, a clip and ring, a clasp and a hook and loop fastener. The tool lanyard wrist cuff is a flexible material that may optionally be a stretchable material as well. Nylon, polyester or other similar materials may also be used to form the wrist cuff of the present invention.

The lanyard retaining component may have various structural members. One example is a ring secured to the outside surface of the fixed closed loop band in a location that is away from the fastening mechanism used to secure the wrist cuff band around a user's wrist. The ring may be a D-ring secured to the outside surface of the closed loop band. The securing mechanism may be a strip of webbing that captures a portion of the ring between the strip of webbing and the outside surface of the closed loop band. Another example of a lanyard retaining component is a retractable cord enclosure such as a pocket attached to the outside surface of the closed loop band. The retractable cord enclosure includes an opening through which a retractable cord extends from inside the enclosure to the outside. The retractable cord includes a releasable fastener attached to the cord end disposed outside of the enclosure/pocket. The releasable fastener is typically secured to a hand tool.

The present invention also provides a method of restraining a tool to a wrist of a user. In one embodiment, the method includes folding a strip of material onto itself where the first end of the strip is spaced from the second end of the strip, fixedly attaching the first end of the strip to the body of the strip material forming a closed loop band from a major portion of the strip material and a tab that extends from the closed loop band. The method also includes securing a first mating portion of a fastening mechanism to an outside surface of the closed loop band, securing a second mating portion of the fastening mechanism to the tab and attaching a lanyard retaining mechanism to the outside surface of the closed loop band where the lanyard retaining mechanism is spaced from the tab.

In another embodiment, the method further includes selecting a fastening mechanism from various components including, but not limited to, a strap and buckle, a snap button, a button and strap with button holes, a clip and ring arrangement, a clasp arrangement, and a hook and loop fastener.

In a further embodiment, the method includes selecting a lanyard retaining mechanism from various devices including, but not limited to, a secured ring or a retractable cord enclosure such as a retractable cord pocket that are attached to the outside surface of the closed loop band. The secured ring may be a D-ring that is attached using a strip of webbing connected to the closed loop band. The method further includes forming an opening in the retractable cord enclosure/pocket through which a retractable cord passes. When an openable pocket is formed, the method includes forming a pocket closing mechanism to securely retain the retractable cord within the enclosure/pocket.

DETAILED DESCRIPTION OF THE PREFERRED EMBODIMENT

Figure 1:
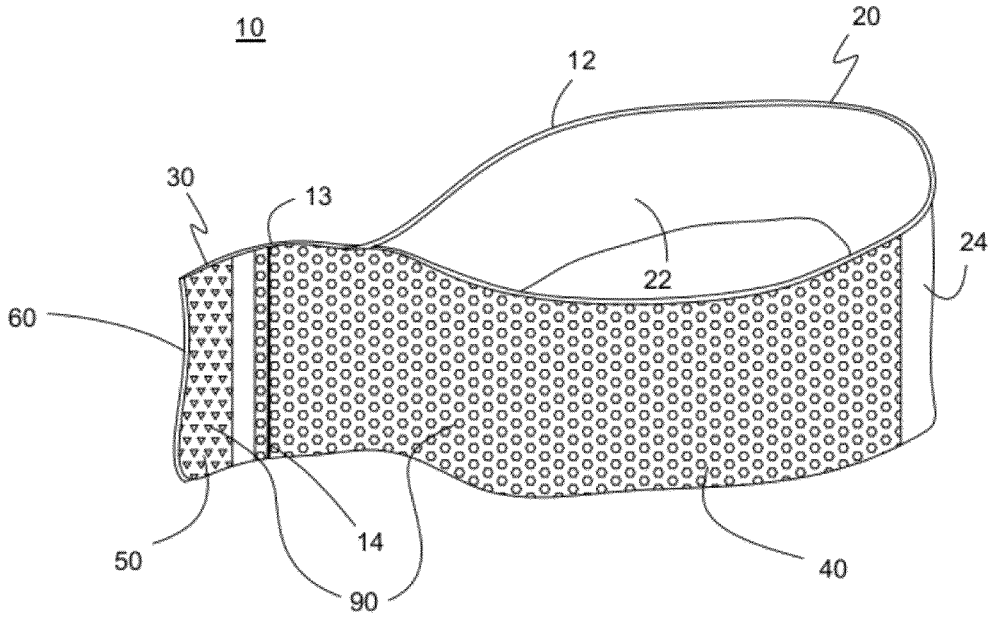
FIG. 1 is a perspective view of one embodiment of the present invention showing the front of the tool lanyard wrist cuff.

The preferred embodiment(s) of the present invention is illustrated in FIGS. 1-5. FIG. 1 illustrates one embodiment of a tool lanyard wrist cuff 10 of the present invention. Tool lanyard wrist cuff 10 includes a permanently fixed, closed loop band 20 and an adjustment tab 30 that extends from closed loop band 20. Closed loop band 20 has an elongated body 21 made of a flexible, pliable material preferably a stretchable nylon or polyester or similar material, with an inside surface 22 and an outside surface 24. Although various fastening devices can be used, a hook and loop fastening mechanism 90 is preferably used to adjust the tool lanyard wrist cuff 10 to a user's wrist. One part of the hook and loop fastening mechanism (preferably the loop part) 40 is fixedly attached to outside surface 24 of elongated body 21 beginning at the point of contact of adjustment tab 30 with closed loop band 20 and extending over a portion of outside surface 24. It should be noted that a plurality of individual, spaced or non-spaced strips may also be used instead of a single, elongated piece of the fastening mechanism 40. The mating part of the hook and loop fastening mechanism 90 (preferably the hook part 50) is fixedly attached on a surface of adjustment tab 30 that positions the hook part 50 of the hook and loop fastening mechanism 90 against the loop part 40 of the hook and loop mechanism 90 when closed loop band 20 is folded upon itself and adjustment tab 30 is attached onto outside surface 24 of closed loop band 20.

Adjustment tab 30 may be a separate component attached to closed loop band 20 or it may be an extension of elongated body 21 that extends away from closed loop band 20. When adjustment tab 30 is an extension of elongated body 21, a first body end 13 of elongated body 21 is fixedly attached at a location 14 along elongated body 21 forming closed loop band 20 with adjustment tab 30 being the remaining portion of elongated body 21 that extends beyond the formed loop band 20.

Figure 2:
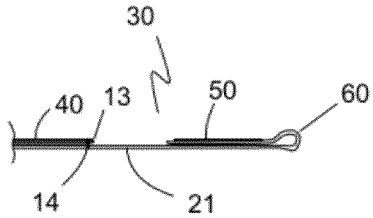
FIG. 2 is a side view of adjustable tab of the embodiment shown in FIG. 1.

Turning now to FIG. 2, there is illustrated a side view of adjustment tab 30. In this embodiment of tool lanyard wrist cuff 10, adjustment tab 30 is the extension of elongated body 21 which is folded upon itself forming a tab 30. Fixedly attached to adjustment tab 30 is hook fastening mechanism 50. Loop fastening mechanism 40 is attached to outside surface 24 of elongated body 21. Elongated body 21 is attached to itself at end 13 along location 14. End 13 may be attached by sewing, staples, rivets, adhesive, and the like.

Figure 3:
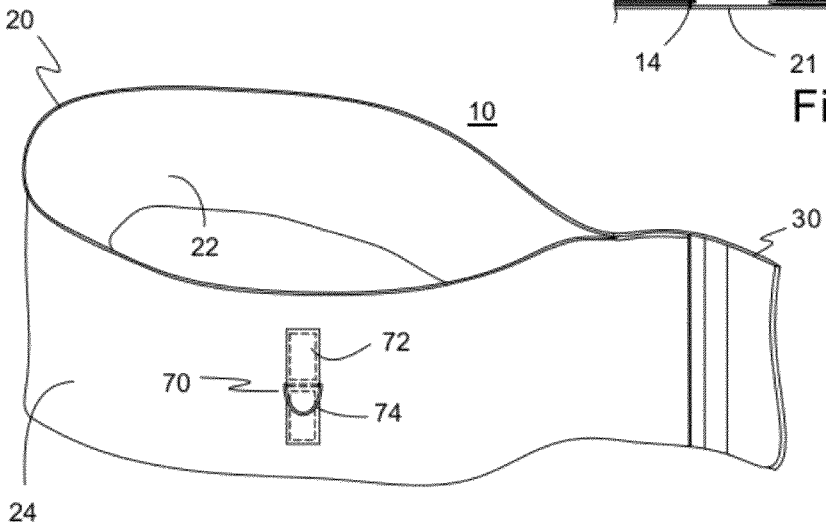
FIG. 3 is a perspective view of the embodiment in FIG. 1 showing the back of the tool lanyard wrist cuff.

FIG. 3 illustrates an attachment ring assemblage 70 attached to outside surface 24 of closed loop band 20. In this embodiment, attachment ring assemblage 70 includes a ring retaining strip 72 that captures a lanyard ring 74. The adjustment tab 30 as well as a portion of closed loop band 20 folds across outside surface 24 and attaches hook fastening mechanism 50 to loop fastening mechanism 40. By being able to fold a portion of closed loop band 20 upon itself with adjustment tab 30, the size of closed loop band 20 can be easily adjusted to comfortably fit around a user's wrist.

One method of making tool lanyard wrist cuff 10 will now be described. A predefined length of a flexible material, preferably a stretchable nylon or polyester (or similar material), is obtained to form elongated body 21. A strip of loop fastening mechanism 40 is attached (preferably stitched) adjacent one end 13 of and onto the elongated body 21 on a side of elongated body 21 that will become outside surface 24. Adjacent the opposite end 16 of the elongated body 21, a strip of hook fastening mechanism 50 is attached (also preferably sewn) on the same side of elongated body 21 as the loop fastening mechanism 40. Elongated body 21 is folded on itself with loop fastening mechanism 40 on the outside of the folded body 21 and end 13 being positioned a predefined distance from end 16. The size of closed loop band 20 is formed to be large enough to be able to slide closed loop band 20 over a user's hand for placement on a user's wrist. Once the proper size of loop band 20 is formed, end 13 is stitched to elongated body 21 forming a permanently fixed, closed loop band 20 and adjustment tab 30 extending away from closed loop band 20 at location 14. End 16 is folded over along a surface that is a continuation of inside surface 22 of elongated body 21 so that hook fastening mechanism 50 exposed. The length of end 16 that is folded is such that a sufficient surface area of the hook fastening mechanism 50 is formed as an inside surface 22 to securely connect and hold with loop fastening mechanism 40. The length is also sufficient to allow tab 30 to be formed to make pulling adjustment tab 30 easier when removing the tool lanyard wrist cuff 10. The use of a predefined loop band 20 and the folding method of securing tool lanyard wrist cuff 10 provide a one-size-fits-all wrist cuff where the snugness of the wrist cuff is infinitely adjustable to a user's preference.

Attachment ring assemblage 70 is connected to outside surface 24. Ring retaining strip 72, which is preferably a piece of ½" webbing, is stitched with its longer axis positioned across the width of elongated body 21 at a position defined as being a perpendicular line across the center of closed loop band 20 when closed loop band 20 is laying flat upon itself. Captured in ring retaining strip 72 is lanyard ring 72, which is preferably a D-ring that can be used to tether tools to tool lanyard wrist cuff 10.

Figure 4:
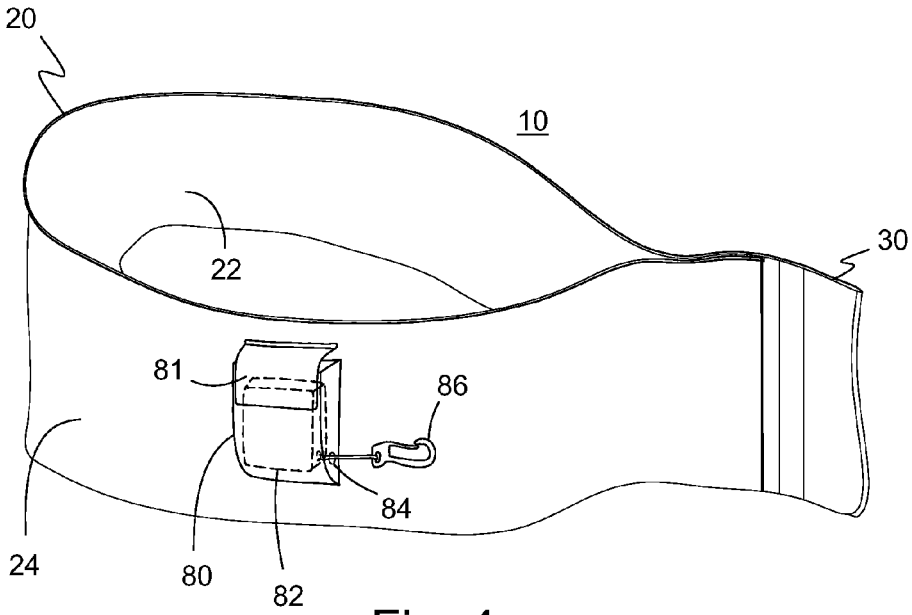
FIG. 4 is a perspective view of another embodiment of the present invention showing the wrist cuff with a retractable cord pocket.

As an alternative to attachment ring assemblage 70, a pocket 80 can be formed on or in outside surface 24 as illustrated in FIG. 4. Pocket 80 may optionally house a cable retraction unit 82 with a snap hook 86 or similar fastening hardware that will egress through the pocket 80 either by a sewn opening or grommet 84, thus, making tool lanyard wrist cuff 10 into a wrist cuff retractable lanyard. The snap hook 86 or similar fastening hardware will be used to tether tools to the wrist cuff retractable lanyard. The pocket 80 may be a sealed enclosure or incorporate an openable pocket flap 81 to facilitate removal of the cable retraction unit 82. Pocket flap 81 may be secured to pocket 80 using any of the previously described fastening mechanisms. The hook and loop fastening system, however, is preferred.

Figure 5:
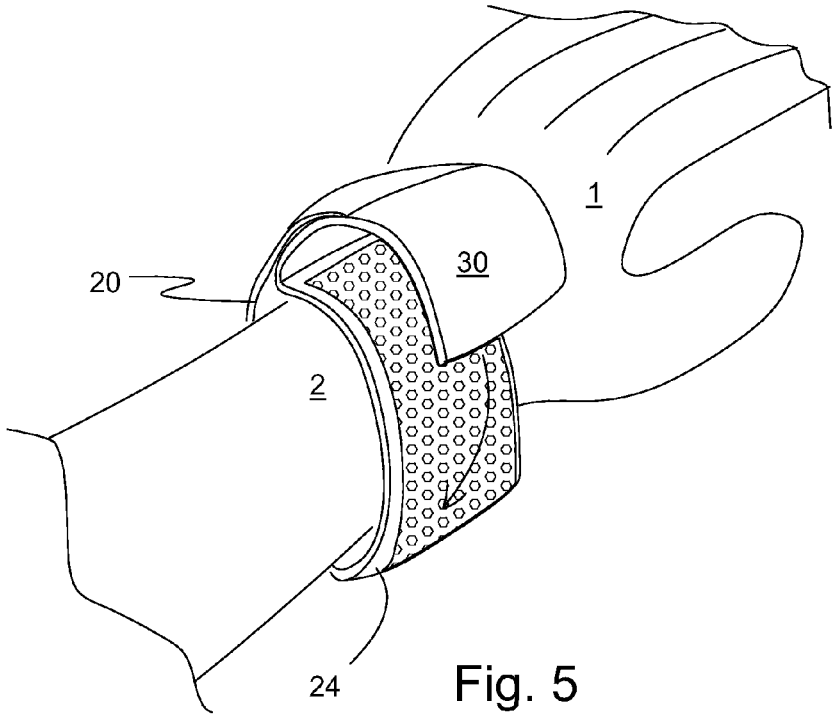
FIG. 5 is a perspective view of the embodiment illustrated in FIG. 1 attaching to a wrist of a user.

To use tool lanyard wrist cuff 10, a user's hand is inserted through closed loop band 20. FIG. 5 illustrates the tool lanyard wrist cuff 10 being secured around a wrist 2 of a user. To use tool lanyard wrist cuff 10, a user inserts the user's hand 1 through closed loop band 20 bringing wrist cuff 10 to the user's wrist 2. To tighten tool lanyard wrist cuff 10 about the user's wrist 2, closed loop band 20 is folded over onto itself creating a snug fit around the user's wrist 2. While maintaining the desired snug fit of the folded closed loop band 20 around the user's wrist 2, adjustment tab 30 with hook fastening mechanism 50 (which is preferably a hook fabric of a hook and loop fastener) is then connected to outside surface 24 having loop fastening mechanism 40 (which is preferably a loop fabric of a hook and loop fastener). Because tool lanyard wrist cuff 10 uses a fold-over method to secure wrist cuff 10 to a user's wrist 2, wrist cuff 10 can be adjusted to the comfort of the user during the process of tightening closed loop band 20 around the user's wrist 2. As described, tool lanyard wrist cuff 10 of the present invention is a true one-size-fits-all wrist device that maintains an attached tool lanyard securely about the wrist.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An adjustable tool lanyard wrist cuff for securing the wrist cuff to a range of wrist sizes, the tool lanyard wrist cuff comprising:

a permanently fixed, closed loop band with a predefined loop circumference formed by folding a strip of material onto itself where a first end of the strip is spaced from a second end of the strip at a predefined distance along the strip of material, the first end being permanently secured to the strip and the predefined loop circumference being sized to adjustably secure the fixed, closed loop band to a range of wrist sizes by wrapping around a wrist in a manner that folds the permanently fixed closed loop band upon itself, the fixed closed loop having a first mating portion of a fastening mechanism fixedly attached to an outside surface of the closed loop band;

an adjustment tab formed by the strip of material that extends from the first end of the strip that is permanently secured to the strip of material to the second end, the adjustment tab having a second mating portion of the fastening mechanism configured for releasable engagement with the first mating portion when the fixed closed loop band is folded onto itself positioning the adjustment tab over and onto the outside surface of the closed loop band; and a lanyard retaining component integrally formed on and fixedly attached to the outside surface of the closed loop band.

2. The tool lanyard wrist cuff of claim 1 wherein the fastening mechanism is selected from the group consisting of a strap and buckle, a snap button, a button and strap with button holes, a clip and ring, a clasp, and a hook and loop fastener.

3. The tool lanyard wrist cuff of claim 1 wherein the fixed closed loop band is made of a stretchable material.

4. The tool lanyard wrist cuff of claim 3 wherein the stretchable material is nylon, polyester, or similar material.

5. The tool lanyard wrist cuff of claim 1 wherein the lanyard retaining component is selected from the group consisting of a secured ring and a retractable cord pocket.

6. The tool lanyard wrist cuff of claim 5 wherein the secured ring includes a webbing material connecting the ring to the outside surface of the closed loop band.

7. The tool lanyard wrist cuff of claim 5 wherein the pocket further includes a retractable cord disposed within the pocket and extending outside of the pocket and a releasable fastener connected to an end of the retractable cord that extends outside of the pocket.

8. A method of making an adjustable tool lanyard wrist cuff for securing the wrist cuff to a range of wrist sizes, the method comprising:

folding a strip of material onto itself where a first end of the strip is spaced from a second end of the strip at a predefined distance along the strip of material;

fixedly and permanently attaching the first end of the strip to the strip of material forming a closed loop band from a major portion of the strip material having a predefined loop circumference wherein the predefined loop circumference has a size that is capable of adjustably securing the closed loop band to a range of wrist sizes by wrapping around a wrist in a manner that folds the permanently fixed closed loop band upon itself and forming a tab extending from the first end of the strip that is permanently secured to the strip of material to the second end;

securing a first mating portion of a fastening mechanism to an outside surface of the closed loop band at a predefined location;

securing a second mating portion of the fastening mechanism to the tab that is capable of mating with the first mating portion when the fixed closed loop band is folded onto itself wherein the adjustment tab is positioned over and onto the outside surface of the closed loop band; and attaching a lanyard retaining mechanism to the outside surface of the closed loop band wherein the lanyard retaining mechanism is spaced from the tab.

9. The method of claim 8 further comprising selecting the fastening mechanism from the group consisting of a strap and buckle, a snap button, a button and strap with button holes, a clip and ring, a clasp, and a hook and loop fastener.

10. The method of claim 8 further comprising selecting the lanyard retaining mechanism from the group consisting of a secured ring and a retractable cord pocket with a retractable cord and a releasable fastener connected to an end of the retractable cord that extends outside of the pocket.

* * * * *